US012275553B2

(12) United States Patent
Whitta et al.

(10) Patent No.: US 12,275,553 B2
(45) Date of Patent: Apr. 15, 2025

(54) WEATHERPROOF SPORTSMAN'S TRUNK

(71) Applicant: CREATIVE PLASTIC CONCEPTS, LLC, Sycamore, OH (US)

(72) Inventors: Jacob H. Whitta, Bluffton, OH (US); Ben Sayalith, Findlay, OH (US); Eric Hummel, Findlay, OH (US); Tony Vilay, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 0 days.

(21) Appl. No.: 18/472,333

(22) Filed: Sep. 22, 2023

(65) Prior Publication Data

US 2024/0010381 A1 Jan. 11, 2024

Related U.S. Application Data

(63) Continuation of application No. 17/980,908, filed on Nov. 4, 2022, now Pat. No. 11,897,658.

(60) Provisional application No. 63/277,349, filed on Nov. 9, 2021.

(51) Int. Cl.

| | |
|---|---|
| ***B65D 1/22*** | (2006.01) |
| ***B65D 25/28*** | (2006.01) |
| ***B65D 43/06*** | (2006.01) |
| ***B65D 45/20*** | (2006.01) |

(52) U.S. Cl.

CPC ..... *B65D 1/22* (2013.01); *B65D 25/282* (2013.01); *B65D 43/06* (2013.01); *B65D 45/20* (2013.01); *B65D 2251/1083* (2013.01); *B65D 2525/284* (2013.01); *B65D 2543/00537* (2013.01); *B65D 2543/00953* (2013.01)

(58) Field of Classification Search

CPC ..... B65D 1/22; B65D 25/282; B65D 43/06; B65D 45/20; B65D 2251/1083; B65D 2525/284; B65D 2543/00537; B65D 2543/00953; B65D 25/20; A45C 5/04

See application file for complete search history.

(56) References Cited

U.S. PATENT DOCUMENTS

| | | | |
|---|---|---|---|
| D643,717 | S | 8/2011 | Reinhart et al. |
| D648,535 | S | 11/2011 | Reinhart et al. |
| D648,538 | S | 11/2011 | Reinhart |
| D737,574 | S | 9/2015 | Reinhart |
| D743,171 | S | 11/2015 | Reinhart |
| D744,239 | S | 12/2015 | Reinhart |
| D744,240 | S | 12/2015 | Reinhart |
| D756,652 | S | 5/2016 | Reinhart |
| D765,397 | S | 9/2016 | Reinhart |
| D765,407 | S | 9/2016 | Reinhart |
| D765,408 | S | 9/2016 | Reinhart |
| D765,409 | S | 9/2016 | Reinhart |
| D765,410 | S | 9/2016 | Reinhart |

(Continued)

*Primary Examiner* — Kareen K Thomas

(74) *Attorney, Agent, or Firm* — Thompson Coburn LLP

(57) ABSTRACT

A storage trunk including a container, a lid, a latch and a seal is provided. The container can include an upper surface, a plurality of sidewalls, and a bottom surface. The lid can include a top section and a lip disposed adjacent to the top section. The lip can include a latch receiving section having a lock receiving section. The lid can be removably secured to the container. The latch can be connected to the container. The seal can be disposed adjacent to the lip of the lid. In certain embodiments, the storage trunk can include a tie-down element, a handle, and/or a wheel.

20 Claims, 5 Drawing Sheets

(56) References Cited

U.S. PATENT DOCUMENTS

| | | | | |
|---|---|---|---|---|
| D765,411 | S | 9/2016 | Reinhart | |
| D766,577 | S | 9/2016 | Reinhart | |
| D768,385 | S | 10/2016 | Reinhart | |
| D773,821 | S | 12/2016 | Reinhart | |
| 9,511,491 | B2 * | 12/2016 | Brunner | B25H 3/02 |
| D776,932 | S | 1/2017 | Reinhart | |
| D781,586 | S | 5/2017 | Reinhart | |
| D790,858 | S | 7/2017 | Reinhart | |
| D794,958 | S | 8/2017 | Reinhart | |
| D834,315 | S | 11/2018 | Reinhart | |
| 10,236,711 | B1 | 3/2019 | Miller | |
| 10,399,748 | B2 | 9/2019 | Reinhart | |
| D878,054 | S | 3/2020 | Reinhart et al. | |
| D881,576 | S | 4/2020 | Reinhart et al. | |
| 10,800,528 | B1 * | 10/2020 | Williams | B60P 7/0807 |
| 10,843,852 | B2 | 11/2020 | Reinhart et al. | |
| 10,865,015 | B2 * | 12/2020 | Brennan | B60R 9/06 |
| 10,899,499 | B2 * | 1/2021 | Reinhart | B65D 21/0215 |
| D910,312 | S | 2/2021 | Reinhart et al. | |
| D912,984 | S | 3/2021 | Reinhart et al. | |
| D932,188 | S | 10/2021 | Reinhart et al. | |
| 11,203,465 | B2 * | 12/2021 | Seiders | B65D 43/22 |
| 11,220,376 | B2 | 1/2022 | Reinhart | |
| 11,390,307 | B2 | 7/2022 | Reinhart et al. | |
| 11,440,723 | B2 | 9/2022 | Reinhart et al. | |
| 11,548,685 | B2 | 1/2023 | Reinhart et al. | |
| 11,618,610 | B2 | 4/2023 | Whitta et al. | |
| 2012/0152944 | A1 * | 6/2012 | Vilkomirski | B25H 3/022 220/849 |
| 2018/0340356 | A1 | 11/2018 | Brennan et al. | |
| 2019/0047753 | A1 | 2/2019 | Koo | |
| 2020/0102135 | A1 | 4/2020 | Reinhart et al. | |
| 2020/0172137 | A1 * | 6/2020 | Ryan | B65D 11/1833 |
| 2021/0031964 | A1 | 2/2021 | Reinhart et al. | |
| 2021/0047075 | A1 | 2/2021 | Reinhart et al. | |
| 2021/0129399 | A1 | 5/2021 | Reinhart et al. | |
| 2021/0129884 | A1 | 5/2021 | Reinhart et al. | |
| 2021/0229867 | A1 | 7/2021 | Schober et al. | |
| 2022/0097926 | A1 * | 3/2022 | Whitmire | B25H 3/02 |
| 2022/0119166 | A1 | 4/2022 | Reinhart | |
| 2022/0403682 | A1 | 12/2022 | Bergum et al. | |
| 2023/0100589 | A1 | 3/2023 | Whitta et al. | |
| 2023/0142041 | A1 * | 5/2023 | Whitta | B65D 43/06 220/324 |

* cited by examiner

WEATHERPROOF SPORTSMAN'S TRUNK

CROSS-REFERENCE TO RELATED APPLICATIONS

This application is a continuation of U.S. patent application Ser. No. 17/980,908, filed on Nov. 4, 2022, which claims the benefit of U.S. Provisional Application No. 63/277,349, filed on Nov. 9, 2021. The entire disclosures of the above applications are incorporated herein by reference.

FIELD

The present technology relates to generally to storage trunks and, more particularly, to weatherproof storage trunks.

INTRODUCTION

This section provides background information related to the present disclosure which is not necessarily prior art.

Storage trunks are commonly used for commercial and residential applications. It is typical to store contents such as tools, recreational equipment, sporting and outdoor equipment, supplies, materials, and the like in storage trunks. A lid covers an open end of the storage trunk to secure and protect the contents contained within the trunk. Some storage trunks also include locking mechanisms for securing the lid to the storage trunk.

Such storage trunks may be used to store and transport heavy items over long distances. Design and configuration of certain components, such as wheels and handles, may not facilitate the transport of a storage trunk as intended if these components are not properly positioned on the storage trunk and sufficiently durable. Likewise, storage trunks are often not adapted to stack efficiently on top of one another, which can present issues with respect to storage and transport of multiple storage trunks.

Another issue relating to the use of storage trunks for storing contents involves a lack of adequate weatherproof components. Many storage trunks cannot keep items stored within dry and moisture-free when stored outside during inclement weather. Components such as lids, seals, locks, latches, and hinges that are not waterproof may result in the spoiling or destruction of the contents within the storage trunk, and hence reduced user satisfaction.

Accordingly, there is a continuing need for a storage trunk that is durable, configured for ease of transport, and that can be easily stored and stacked in combination with other storage trunks. Desirably, the storage trunk is constructed using weatherproof components such that the storage trunk may safely store items outdoors during inclement weather.

SUMMARY

In concordance with the instant disclosure, a durable storage trunk that can be easily stored and stacked in combination with other storage trunks, and that is constructed using weatherproof components such that the storage trunk may safely store items outdoors during inclement weather, has surprisingly been discovered.

A storage trunk including a container, a lid, a latch, and a seal is provided. The container can include an upper surface, a plurality of sidewalls, and a bottom surface. The lid can include a top section and a lip disposed adjacent to the top section. The lip can include a latch receiving section having a lock receiving section. The lid can be removably secured to the container. The latch can be connected to the container. The seal can be disposed adjacent to the lip of the lid.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
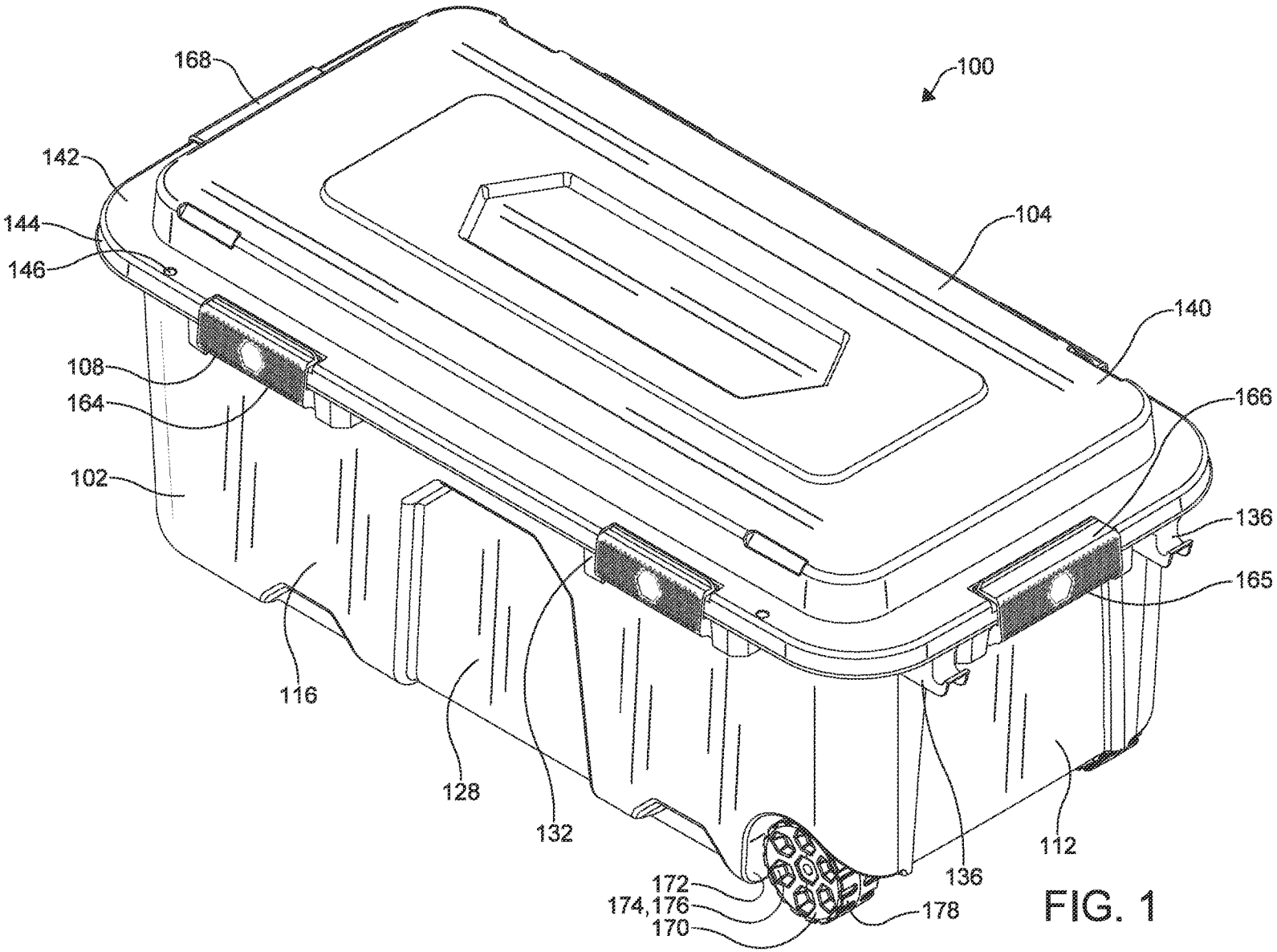
FIG. 1 is a top perspective view of a storage trunk of the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology relates to a storage trunk 100, an embodiment of which is shown generally in FIGS. 1-6. The storage trunk 100 is configured for ease of transport and includes features positioned to optimize durability and ease of use. Aspects of the storage trunk 100 further facilitate storage and stacking thereof with respect to other such storage trunks 100. The storage trunk 100 configuration can provide improved weatherproofing compared to other storage containers, allowing the storage trunk 100 to safely store items outdoors during inclement weather.

With reference to FIGS. 1-4, the storage trunk 100 includes a container 102, a lid 104, and a seal 106. The lid 104 can be removably secure to the container 102 by a latch 108. The storage trunk 100 can be formed using any durable, water-resistant material. As a non-limiting example, plastic can be used. More specifically, the storage trunk 100 can be formed from various polyolefins and mixtures thereof, polypropylene, high density polyethylene (HDPE), and/or polyethylene terephthalate (PET). One of ordinary skill in the art can select any suitable material for forming the storage trunk 100 within the scope of the present disclosure.

Figure 2:
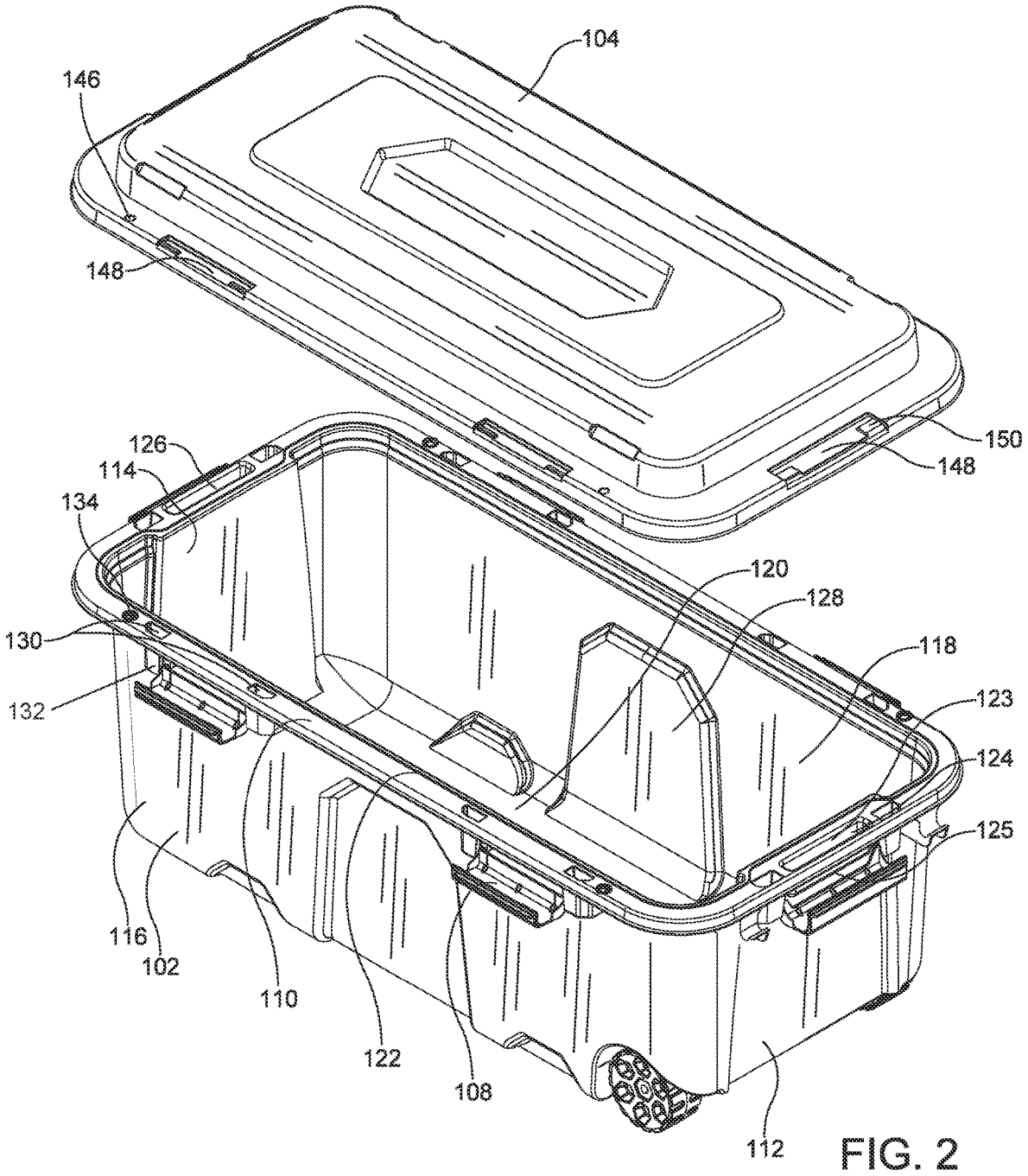
FIG. 2 is a top exploded perspective view of a lid and a container of the storage trunk.

As shown in FIG. 2, the container 102 can have an upper surface 110, a plurality of sidewalls 112, 114, 116, 118, and a bottom surface 120. The plurality of sidewalls 112, 114, 116, 118 can include a first sidewall 112, a second sidewall 114, a front sidewall 116, and a rear sidewall 118. The container 102 can include a ridge 122 disposed on the upper surface 110. The ridge 122 can be a semi-cylindrical portion that extends upwardly from the upper surface 110 and configured to contact the seal 106. One of ordinary skill in the art can select a suitable shape for the ridge 122 and a complementary shape for the seal 106 to allow for the ridge 122 to contact at least a portion of the seal 106 therein.

With continued reference to FIG. 2, the container 102 can include a handle 124 disposed on the upper surface 110. As a non-limiting example, the handle 124 can include a handle recess 123 disposed on the upper surface of the handle. Alternatively, the handle 124 can be a protuberance 125 extending outwardly from the container. With further reference to FIG. 2, the container 102 can include a second handle 126. Where the container 102 include a pair of handles 124, 126, the handles 124, 126 can be disposed on opposite sides of the upper surface 110 of the container 102. As a non-limiting example, the first handle 124 can be disposed on the upper surface 110 adjacent to the first sidewall 112 and the second handle 126 can be disposed on the upper surface 110 adjacent to the second sidewall 114. The first handle 124 and the second handle 126 can be configured to provide an ergonomic location for a user to lift the container 102 of the storage trunk 100. Advantageously, one or both of the handles 124, 126 can allow for the trunk 100 to be easily transported or carried.

Figure 5:
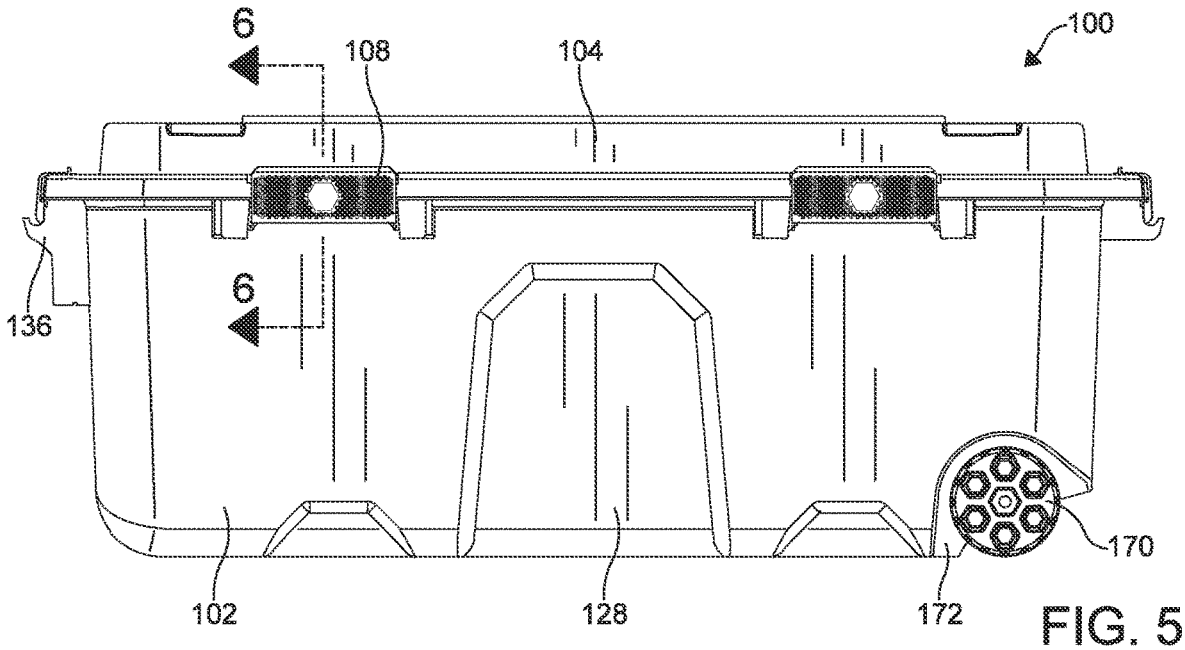
FIG. 5 is a front elevational view of the storage trunk.

As shown in FIGS. 1-2 and 5, at least one of the first sidewall 112, the second sidewall 114, the front sidewall 116, and the rear sidewall 118 can have a support indentation 128. The support indentation 128 can extend inwardly from the container 102 and can provide structural support for the storage trunk 100. The support indentation 128 can extend inwardly from the container 102 for any depth such that support (e.g., resistance to flexing) is provided to the storage trunk 100. There can be any number of support indentations 128 along the first sidewall 112, the second sidewall 114, the front sidewall 116, and/or the rear sidewall 118. Advantageously, this can allow for the storage trunk 100 to have a desired number of support indentations 128 adequate to provide additional structural support for variable sizes of the storage trunk 100. One of ordinary skill in the art can select a suitable number of support indentations 128 to allow for the storage trunk 100 to have additional support.

With continued reference to FIGS. 1-2 and 5, the support indentation 128 can be any shape such that support is provided to the storage trunk 100. As a non-liming example, and as shown in FIG. 1, the support indentations 128 can be polygonal in shape. Further, the support indentations 128 can be any height and any length along the first sidewall 112, the second sidewall 114, the front sidewall 116, and/or the rear sidewall 118. As such, the support indentation 128 can be uniform in shape and size, or variable in shape and size, as determined by the structural needs of the storage trunk 100. One of ordinary skill in the art can select a suitable height, width, and depth for the support indentations 128 within the scope of the present disclosure.

The container 102 can include one or more recesses 130 disposed on the upper surface 110, as provided in FIG. 2. Each recess 130 can extend downwardly from the upper surface 110 and, in some embodiments, each recess 130 can be connected to both the upper surface 110 and one or more of first sidewall 112, the second sidewall 114, the front sidewall 116, and/or the rear sidewall 118. Each recess 130 can have a latch receiving component 132 configured to removably and rotatably connect to the latch 108. In this way, a pair of recesses 130 and associated latch receiving components 132 can flank each latch 108.

As shown in FIG. 2, the container 102 can include one or more openings 134 on the upper surface 110. Each opening 134 can be configured to receive a portion of the lid 104 and can be any shape and size and act as a guide as the lid 104 is placed on the container 102 and ensure that the container 102 and lid 104 fit together properly and allow for a weatherproof seal when as the latch 108 is closed. As a non-limiting example, the opening 134 can be cylindrical in shape. Further, the opening 134 can be a hollow channel without a bottom portion or the opening can have a bottom portion, as desired. Advantageously, the opening 134 can allow for a more secure connection between the container 102 and the lid 104. One of ordinary skill in the art can select a suitable shape, size, and number of openings 134 within the scope of the present disclosure.

Figure 3:
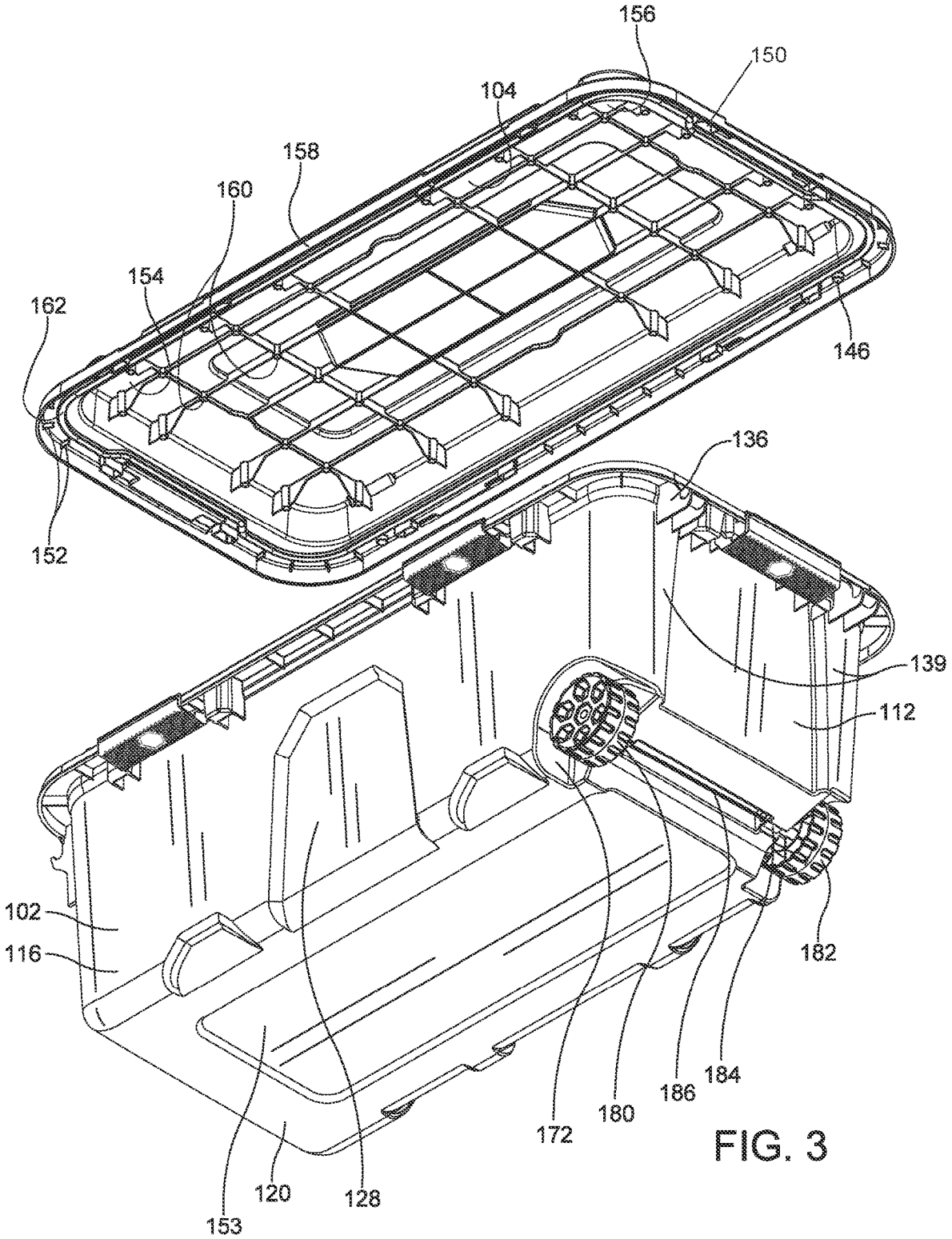
FIG. 3 is a bottom exploded perspective view of the lid and the container of the storage trunk.

With reference to FIGS. 1, 3, and 5, the container 102 of the storage trunk 100 can have on or more tie-down elements 136. The tie-down element 136 can be any shape that can allow for the storage trunk 100 to be secured. The tie-down element 136 can be a protrusion such as a hook-like projection, as one non-limiting example. Advantageously, the tie-down element 136 can allow for the storage trunk 100 to be secured to a surface. With further reference to FIGS. 1, 3, and 5, one or more tie-down elements 136 can be disposed on one or more of the first sidewall 112, the second sidewall 114, the front sidewall 116, and the rear sidewall 118. One of ordinary skill in the art can select any suitable location on the container 102 or the lid 104 of the storage trunk 100 within the scope of the present disclosure.

As shown in FIG. 3, the main body can include a stacking stop disposed on the container and adjacent to the handles. The stacking stop can militate against a first storage trunk 100 and a subsequent storage trunk from fully stacking within each other and creating a vacuum. Advantageously, this can allow the storage trunk to be stored without becoming stuck and breaking.

The lid 104, as shown in the embodiment of the storage trunk 100 depicted in the figures, can have a top section 140 and a lip 142. The lip 142 can form an outer perimeter 144 of the lid 104 and can be adapted to fit around the upper surface 110 of the container 102. Further, the top section 140 can be located within the outer perimeter 144 formed by the lip 142. At least one protuberance 146 can extend downwardly from the lip 142 of the lid 104. The protuberance 146 can be adapted to fit in the opening 134 of the container 102. The protuberance 146 can be cylindrical in shape, however, any suitable size and shape can be used, as desired. The protuberance 146 can form a friction fit or other fit with the opening 134 of the container 102, as desired. Various complementary shapes and sizes of the protuberance 146 of the lid 104 and the opening 134 of the container 102 can be used to facilitate coupling of the lid 104 to the container 102.

With reference to FIG. 2, the lid 104 can include one or more latch receiving sections 148. The latch receiving section 148 can be a recessed section disposed on the lip 142 of the lid 104. The latch receiving section 148 can have a shape adapted to direct the latch 108 into position and can include at least one lock receiving section 150. However, the lock receiving section 150 can be any component capable of securing or locking the latch 108 to the lid 104.

With reference now to FIG. 3, the lid 104 can include one or more support ridges 152. The support ridge 152 can be disposed on an interior surface 154 of the lip 142. Further, the support ridge 152 can be disposed on at least one corner section 156 of the lid 104 and on the interior surface 154 of the lip 142. Alternatively, the support ridges 152 can be disposed on the interior side of the lid 104. The support ridges 152 can be in a grid configuration and, more specifically, the grid configuration can having multiple intersecting lines in a perpendicular pattern. In a more particular embodiment, the support ridge 152 can be disposed on the corner section 156 of the lid 104 and a side section 158 of the lid 104. Support components 160 can also be included on the lid 104, as determined by one of skill in the art. As a non-limiting example, the lid 104 can include multiple ridges and indentations that act as support components 160. More specifically, the support component 160 can be in the shape of a grid, as shown in FIG. 3, that allows for the lid 104 to have improved rigidity and decrease flexibility of the lid 104. The additional flexibility can militate against the lid 104 breaking. Further, the support components 160 can provide additional support to the lid 104 with respect to the container 102 of the storage trunk 100 and with respect to other bins or items stacked on top of the storage trunk 100, including another storage trunk 100.

As shown in FIG. 3, a lid channel 162 can be disposed on one or both of the lip 142 and the top section 140 of the lid 104. The lid channel 162 can be a semi-cylindrical recessed portion. One of skill in the art can select any suitable shape and configuration for the lid channel 162 within the scope of the present disclosure. The lid channel 162 can be adapted to form a complete channel in cooperation with the ridge 122 when the lid 104 is secured to the container 102, as seen in FIG. 6.

Figure 4:
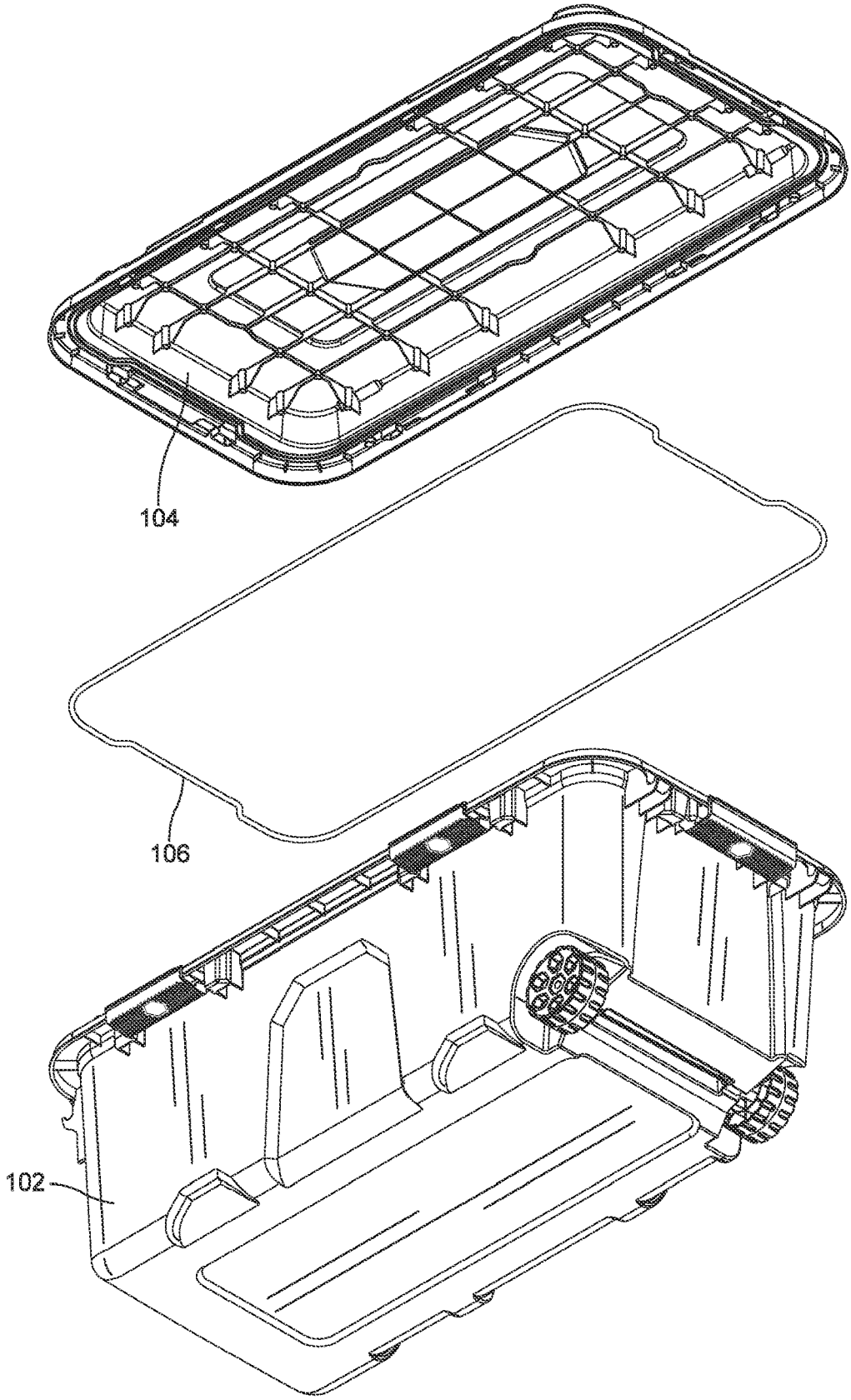
FIG. 4 is a bottom exploded perspective view of the lid, a seal, and the container of the storage trunk.
Figure 6:
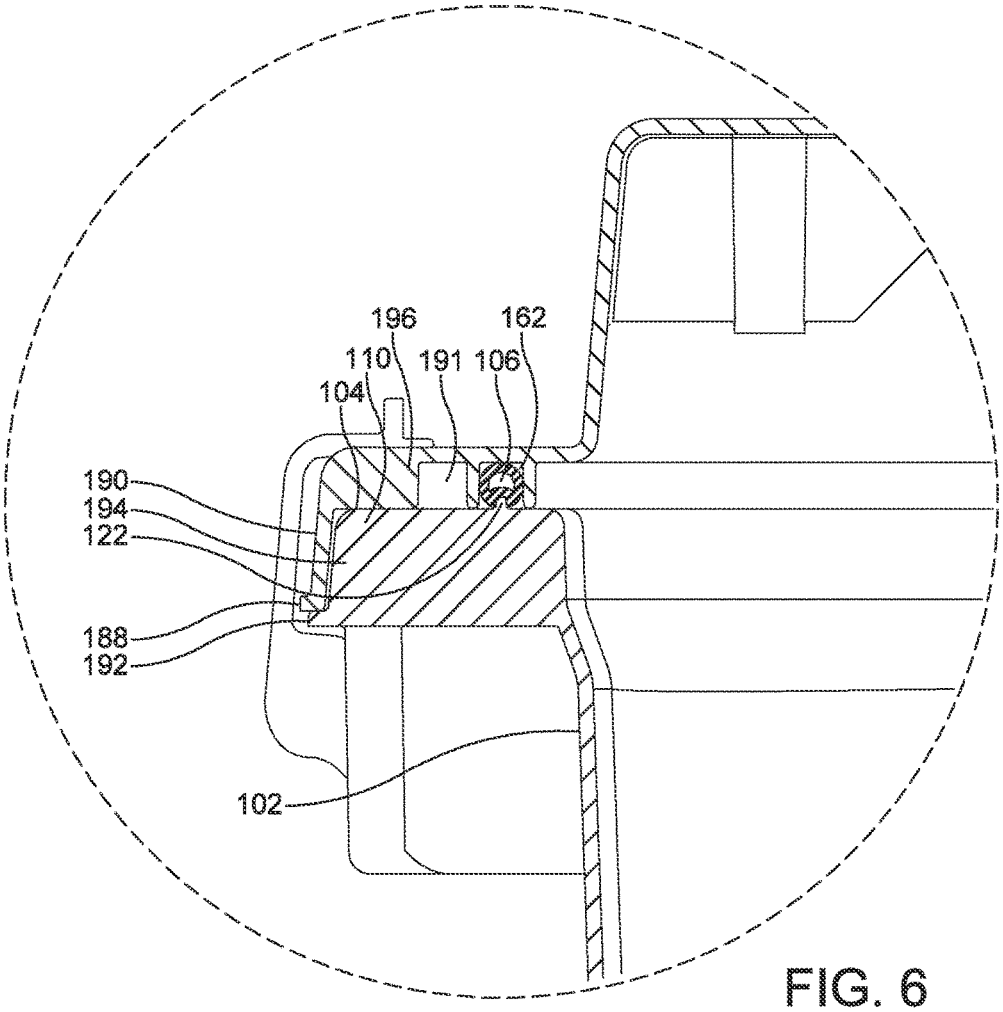
FIG. 6 is a call out from FIG. 5, showing a cross-sectional view of the seal between the lid and the container of the storage trunk.

The seal 106, as shown in FIGS. 4 and 6, can be adapted to fit within the container ridge 122 and the lid channel 162. The seal 106 can be integral with or removably connected to the lid channel 162. When the lid 104 is secured to the container 102 of the storage trunk 100, the seal 106 can fill the hollow space formed between the container ridge 122 and the lid channel 162. Desirably, the container ridge 122 can allow for the container 102 to contact a greater amount of surface area of the seal 106 and provide for a better weatherproofing barrier. The seal 106 can be any suitable size and shape, as determined by one of skill in the art, such that the seal 106 can fit within the container ridge 122 and the lid channel 162. The seal 106 can be formed from any suitable waterproof material. As a non-limiting example, rubber can be used to form the seal 106. More specifically, butyl rubber, ethylene propylene diene monomer rubber (EPDM), or silicone rubber can be used to form the seal 106. One of ordinary skill in the art can select any suitable material for forming the seal 106 within the scope of the present disclosure. Further, the seal can be hollow or solid and one of ordinary skill in the art can select a suitable seal 106 type for within the scope of the present disclosure.

Further, the lid can include a second channel 191 configured to house a second seal (not shown). Advantageously, the second channel 191 and the second seal can allow for a more robust weatherproofing. One of ordinary skill in the art can select a suitable seal number and seal configuration within the scope of the present disclosure.

With continued reference to FIG. 6, the lid 104 can include a terminus foot 188 disposed adjacent to a leg 190 and configured to contact a terminus ledge 192 of the container 102. The terminus ledge 192 of the container 102 can be disposed to adjacent to the lip XXX. Advantageously, the terminus foot 188 and the terminus ledge 192 can cooperate in direct contact to militate against liquid entering the storage trunk 100 or contacting the seal 106, as shown in FIG. 6. Further, the lip XXX of the container 102 can include an outer edge 194. Desirably, the leg 190 of the lid 104 and the outer edge 194 of the container 102 can cooperate in direct contact to militate against liquid entering the storage trunk 100 or contacting the seal 106, as shown in FIG. 6. A first angle formed between the leg 190 and the outer edge 194 contact point and the terminus foot 188 and the terminus ledge 192 can further militate against liquid entering the storage trunk. As a non-limiting example, the angle can be between about 30° and about 150°. One of ordinary skill in the art can select a suitable angle between the leg 190 and the outer edge 194 contact point and the terminus foot 188 and the terminus ledge 192 within the scope of the present disclosure.

With further reference to FIG. 6, the lid 104 can include a block 196 and the upper surface 110 of the container 102. Advantageously, the block 196 and the upper surface 110 can cooperate in direct contact to militate against liquid entering the storage trunk 100 or contacting the seal 106, as shown in FIG. 6. A second angle formed between the leg 190 and the outer edge 194 contact point and the block 196 and the upper surface 110 can further militate against liquid entering the storage trunk. Advantageously, the multiple contact points provided in conjunction with the container ridge 122 can provide for robust weatherproofing. As a non-limiting example, the angle can be between about 30° and about 150°. One of ordinary skill in the art can select a suitable angle between the leg 190 and the outer edge 194 contact point and the block 196 and the upper surface 110 within the scope of the present disclosure.

With reference again to FIGS. 1-2, the latch 108 can be rotatably connected to the container 102 of the storage trunk 100 and can removably secure the lid 104 to the container 102 of the storage trunk 100. The latch 108 can have at least one connecting means (not shown) for rotatably connecting the latch 108 to the container 102 of the storage trunk 100. The connecting means can be a cylindrical protrusion adapted to fit into the latch receiving component 132 disposed on the recess 130 of the container 102 of the storage trunk 100. The latch 108 can be substantially U-shaped and adapted to fit over the lip 142 of the lid 104, thereby securing the lid 104 to the container 102 of the storage trunk 100. One of ordinary skill in the art can select any suitable size and shape for the latch 108, as well as any suitable means for connecting the latch 108 to the container 102 and the lid 104.

The latch 108 can further include a releasing ridge (not shown). The releasing ridge can extend upwardly from the latch 108. Desirably, the releasing ridge can be adapted to allow a user to open and close the latch 108 quickly and easily. Further, in particular embodiments, the latch 108 can also include at least one locking mechanism (not shown). The locking mechanism can also be adapted to form a friction or other fit with the lock receiving section 150 of the lid 104. Any suitable latch 108 can be employed, as determined by one of skill in the art.

With reference to FIG. 1, one or more primary latches 164 can be rotatably connected to one or both of the front sidewall 116 of the container 102 and the rear sidewall 118 of the container 102. The primary latches 164 can include one or more connecting means (not shown) for connecting to one or more latch receiving components 132 disposed on the front sidewall 116 and the rear sidewall 118. In certain embodiments, the size and shape of each of the primary latches 164 can be different. Conversely, the size and shape of each of the primary latches 164 can be substantially similar. Advantageously, the primary latches 164 can work together to create a secure connection between the lid 104 and the container 102.

With continued reference to FIG. 1, the storage trunk 100 can have one or more secondary latches 165, where in the embodiment shown include a first sidewall end latch 166 and a second sidewall end latch 168. The first end latch 166 can be rotatably connected to the first sidewall 112 of the container 102, and the second end latch 168 can be rotatably connected to the second sidewall 114 of the container 102. The first sidewall end latch 166 can be adapted to rotatably connect to a pair latch receiving components 132 of the first sidewall. Likewise, the second sidewall end latch 168 can be adapted to rotatably connect to a pair latch receiving components 132 of the second sidewall. In certain embodiments, the size and shape of the first sidewall end latch 166 and the second sidewall end latch 168 can be different. Conversely, the size and shape of each of the first sidewall end latch 166 and the second sidewall end latch 168 can be substantially similar. Further, the size and shape of each of the plurality of primary latches 164 and the size and shape of each of the plurality of secondary latches 165 can be the same. Advantageously, the secondary latches 165 can create a secure connection between the lid 104 and the container 102. The secondary latches 165 can also work together with the primary latches 164 to secure the lid 104 to the container 102.

As shown in FIGS. 1 and 5, the storage trunk 100 can include one or more wheels 170. The wheel 170 can be disposed on or adjacent to the container 102 of the storage trunk 100. The wheel 170 can be generally cylindrical in shape and can include a plurality of treads. A pair of wheels 170 can be disposed in respective wheel well sections 172 of the storage trunk 100, as shown in FIGS. 1, 3, and 5. The wheels 170 can include a plurality of reinforcement elements 174, as determined by one of skill in the art. As non-limiting examples, the reinforcement elements 174 can be wheel recesses 176 that are hexagonal in shape, or support bars 178, such as treads, that are cylindrical in shape. Any suitable reinforcement element 174 can be employed, as desired.

With continued reference to FIG. 5, the storage trunk can have a pair of wheels 170, specifically, a first wheel 180 and a second wheel 182 connected using a wheel axel 184. The wheel axel 184, as shown in FIG. 5, can be housed in a cavity 186 of the container 102 of the storage trunk 100. The first wheel 180 can be disposed outside of the container 102 adjacent the first sidewall 112 and the front sidewall 116, and the second wheel 182 can be disposed outside of the container 102 adjacent the first sidewall 112 and the rear sidewall 118.

Advantageously, one or more of the support indentations 128 and a bottom surface indentation 153 increase the structural integrity of the container 102, while the lip 142, support ridges 152, and support components 160 increase the structural integrity of the lid 104 of the storage trunk 100. The wheel 170 and the handle 124 can allow the storage trunk to be easily lifted and transported. Additionally, and desirably, the primary latches 164 and secondary latches 166, 168, in combination with the container 102 of the storage trunk 100, the lid 104, the container ridge 122, the lid channel 162, and the seal 106, are adapted to form a waterproof seal for keeping the contents of the storage trunk 100 safe and dry.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A storage trunk, comprising:

a container including an upper surface, a plurality of sidewalls including a first sidewall and a second sidewall, and a bottom surface;

a latch rotatably connected to the container;

a lid including a top section and a lip disposed adjacent to the top section, wherein the lip includes a latch receiving section configured to receive the latch, the lid being configured to be removably secured to the container;

a seal disposed adjacent to the lip of the lid; and a first tie-down element and a second tie-down element, the first tie-down element having a first outwardly projecting portion and a first upwardly projecting portion, the first outwardly projecting portion being fixed to and projecting outwardly from the first sidewall, the first upwardly projecting portion being spaced outwardly from the first sidewall and extending upwardly from the first outwardly projecting portion, the second tie-down element having a second outwardly projecting portion and a second upwardly projecting portion, the second outwardly projecting portion being fixed to and projecting outwardly from the second sidewall, the second upwardly projecting portion being spaced outwardly from the second sidewall and extending upwardly from the second outwardly projecting portion.

2. The storage trunk of claim 1, wherein the container includes a ridge disposed on the upper surface configured to contact the seal.

3. The storage trunk of claim 1, further including a wheel disposed adjacent to the container.

4. The storage trunk of claim 1, wherein the container includes a handle.

5. The storage trunk of claim 4, wherein the handle includes a recess disposed on an upper surface of the handle.

6. The storage trunk of claim 4, wherein the handle is a protuberance extending outwardly from the container.

7. The storage trunk of claim 1, wherein each sidewall of the plurality of sidewalls includes a support indentation extending inwardly from the container.

8. The storage trunk of claim 1, wherein the container includes a recess disposed on the upper surface configured to receive the latch.

9. The storage trunk of claim 8, wherein the recess includes a latch receiving section configured to secure the latch to the container.

10. The storage trunk of claim 1, wherein the container includes an opening configured to receive a portion of the lid.

11. The storage trunk of claim 10, wherein the lip of the lid includes a protuberance extending downwardly from the lip of the lid configured to fit within the opening of the container.

12. The storage trunk of claim 1, wherein the lid includes support ridges.

13. The storage trunk of claim 12, wherein the support ridges are in a grid configuration having multiple intersecting lines.

14. The storage trunk of claim 1, wherein the latch is comprised by a plurality of latches, each of the latches rotatably connected to the container.

15. The storage trunk of claim 14, wherein the plurality of latches is rotatably connected to the plurality of sidewalls.

16. The storage trunk of claim 1, wherein each of the first sidewall and the second sidewall includes two tie-down elements.

17. The storage trunk of claim 1, wherein each of the first tie-down element and the second tie-down element includes a hook.

18. The storage trunk of claim 1, wherein each of the first sidewall and the second sidewall includes a handle recess.

19. The storage trunk of claim 1, wherein the lid includes support components.

20. A storage trunk, comprising:

a container including an upper surface, a plurality of sidewalls including a first sidewall and the second sidewall, and a bottom surface which define an opening, a ridge disposed on the upper surface, a tie-down portion, a handle, a support indentation extending inwardly from the container;

a wheel disposed adjacent to the container;

a latch rotatably connected to a latch receiving section configured to secure the latch to the container;

a lid including a top section and a lip disposed adjacent to the top section, wherein the lip includes a latch receiving section configured to receive the latch, the lid being configured to be removably secured to the container;

a seal disposed adjacent to the lip of the lid and configured to receive the ridge; and a first tie-down element and a second tie-down element, the first tie-down element having a first outwardly projecting portion and a first upwardly projecting portion, the first outwardly projecting portion being fixed to and projecting outwardly from the first sidewall, the first upwardly projecting portion being spaced outwardly from the first sidewall and extending upwardly from the first outwardly projecting portion, the second tie-down element having a second outwardly projecting portion and a second upwardly projecting portion, the second outwardly projecting portion being fixed to and projecting outwardly from the second sidewall, the second upwardly projecting portion being spaced outwardly from the second sidewall and extending upwardly from the second outwardly projecting portion.

* * * * *